US011085096B2

(12) United States Patent
Chen et al.

(10) Patent No.: US 11,085,096 B2
(45) Date of Patent: Aug. 10, 2021

(54) METHOD FOR PREVENTING CRACKING ALONG THE SURFACE AT THE INNER HOLE OF A HOLLOW SHAFT DURING HORIZONTAL WATER QUENCHING

(71) Applicant: SHANGHAI JIAO TONG UNIVERSITY, Shanghai (CN)

(72) Inventors: Nailu Chen, Shanghai (CN); Yonghua Rong, Shanghai (CN); Xunwei Zuo, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 0 days.

(21) Appl. No.: 16/809,602

(22) Filed: Mar. 5, 2020

(65) Prior Publication Data

US 2020/0283865 A1 Sep. 10, 2020

(30) Foreign Application Priority Data

Mar. 6, 2019 (CN) ..... 201910169205.5

(51) Int. Cl.
*C21D 9/08* (2006.01)
*C21D 1/18* (2006.01)
(Continued)

(52) U.S. Cl.
CPC ..... *C21D 9/085* (2013.01); *C21D 1/18* (2013.01); *C21D 1/60* (2013.01); *C21D 9/28* (2013.01);
(Continued)

(58) Field of Classification Search
CPC ..... C21D 9/085; C21D 1/18; C21D 1/60; C21D 9/28; C21D 2211/001;
(Continued)

(56) References Cited

U.S. PATENT DOCUMENTS 4,079,919 A 3/1978 Borg
6,090,230 A * 7/2000 Okamura ..... C21D 9/085 148/590

FOREIGN PATENT DOCUMENTS

CN 101775476 A 7/2010
CN 102965480 A 3/2013
CN 101012491 A 8/2013
(Continued)

OTHER PUBLICATIONS

Zuo et al. ("Development of multi-cycle quenching-partitioning-tempering process and its applications in engineering." International Heat Treatment and Surface Engineering 8.1 (2014): 15-23.) (Year: 2014).*

(Continued)

*Primary Examiner* — Anthony J Zimmer
*Assistant Examiner* — Ricardo D Morales
(74) *Attorney, Agent, or Firm* — True Shepherd LLC; Andrew C. Cheng

(57) ABSTRACT

A method is provided for preventing cracking along the surface at the inner hole of a hollow shaft during water quenching, including: a step of water-quenching the inner hole of the shaft placed horizontally, while the outer circle of the shaft is in a state of air cooling, in which the cooling time of the outer circle is selected to be not lower than its $A_{r1}$ temperature so as to induce a compressive stress in the surface layer of the inner hole; and a step of water-quenching the outer circle and the inner hole of the shaft simultaneously, moreover, the quenching intensity of the inner hole is gradually reduced to cause a temperature rise in the surface layer of the inner hole to allow martensite in the surface layer to undergo self-tempering, which prevents the formation of quenching cracks along the surface of the inner hole.

6 Claims, 3 Drawing Sheets

(51) Int. Cl.

| | |
|---|---|
| ***C21D 1/60*** | (2006.01) |
| ***C22C 38/22*** | (2006.01) |
| ***C22C 38/44*** | (2006.01) |
| ***C21D 9/28*** | (2006.01) |
| ***C22C 38/00*** | (2006.01) |

(52) U.S. Cl.
CPC ..... *C22C 38/22* (2013.01); *C22C 38/44* (2013.01); *C21D 2211/001* (2013.01); *C21D 2211/002* (2013.01); *C21D 2211/009* (2013.01); *C21D 2221/10* (2013.01); *C22C 38/00* (2013.01)

(58) Field of Classification Search
CPC ..... C21D 2211/002; C21D 2211/009; C21D 2221/10; C22C 38/22; C22C 38/44
See application file for complete search history.

(56) References Cited

FOREIGN PATENT DOCUMENTS

| | | | |
|---|---|---|---|
| CN | 103484605 | A | 1/2014 |
| JP | S56136926 | A | 10/1981 |
| SU | 1154345 | A1 | 5/1985 |

OTHER PUBLICATIONS

Youfu Zou et al., Rearch and Practice on Heat Treatment Process Aiming at Preventing Quenching Crack of Medium and Heavy Wall Thichness Tube, Journal, Dec. 2011, p. 46-48, vol. 33, No. 6, Sichuan Metallurgy, Chengdu, China.

* cited by examiner

METHOD FOR PREVENTING CRACKING ALONG THE SURFACE AT THE INNER HOLE OF A HOLLOW SHAFT DURING HORIZONTAL WATER QUENCHING

CROSS-REFERENCE TO RELATED APPLICATIONS

This application claims priority to Chinese Patent Application No. 201910169205.5 with a filing date of Mar. 6, 2019. The content of the aforementioned application, including any intervening amendments thereto, is incorporated herein by reference.

TECHNICAL FIELD

The invention relates to the field of quenching in heat treatment, and specifically to a method for preventing cracking along the surface at the inner hole of a hollow shaft.

BACKGROUND

Quenching is a process of heating a workpiece to the austenite temperature, and then rapidly cooling it to a certain temperature to obtain a martensite or bainite. In order to prevent the formation of quenching cracks, alloy steel is generally quenched by oil or polymer aqueous solution, and rarely by water. The difficulty in water quenching of alloy steel hollow shafts is how to prevent the formation of cracks during quenching. Due to the constraints of the forging process, hollow shafts with large diameter and small hole-diameter are mainly manufactured by overall forging and then machining inner holes after the forging. The hollow shafts with large diameter and manufactured with the above method have problems, such as (1) a small forging ratio, (2) large grain size, (3) loose microstructures, (4) a large number of defects, and (5) low uniformity of various properties along the radial direction, causing that the fracture resistance of the inner hole is much lower than that of the outer circle. The tendency for the inner hole to crack is much greater than that for the outer circle under the same tensile stress.

SUMMARY OF PRESENT INVENTION

The purpose of the invention is to provide a method to avoid the cracking of inner hole of a hollow shaft during horizontal water quenching, which can effectively prevent the generation of quenching cracks and especially solve the most difficult problem of crack generation caused by a hollow shaft with large diameter and small hole-diameter during horizontal water quenching.

According to the invention, the method for preventing cracking along the surface at the inner hole of a hollow shaft during the horizontal water quenching includes the following steps.

Step 1: transferring of quenching parts in which the shaft is transferred from heating furnace to quenching equipment. The duration of this step should be shortened as far as possible to reserve longer time for cooling of the inner hole alone.

Step 2: cooling the inner hole of the shaft alone for a prolonged time. The inner hole is filled with flowing quenchant, the temperature of the surface layer or the sub-surface layer of the inner hole is lower than the A after the prolonged time of cooling, the partial martensitic transformation occurs, and the surface layer or the sub-surface layer of the inner hole is quickly transformed from suffering the tensile stress at the beginning of cooling into suffering the compressive stress or the tensile stress less than that at the beginning of cooling under the superposition effect of the thermal stress and the microstructural (phase transformation) stress.

The outer circle of the shaft is in the state of air cooling such that the temperature of the outer circle is close to $A_{r1}$ temperature, and the $A_{r1}$ temperature is a start temperature of transforming from austenite to pearlite.

Step 3: cooling the outer circle and the inner hole of the shaft treated in the step 2 at the same time. During the cooling, the cooling intensity of the inner hole is adjusted to gradually reduce so that sub-surface layer of the inner hole exhibits low tensile stress while martensite formed in the surface layer experiences self-tempering, which effectively prevent the formation of quenching cracks along the surface of the inner hole.

At the beginning of this stage, the outer circle has been fully pre-cooled because the outer circle has been in the state of a prolonged air cooling in the step 2, which makes the temperature of the outer circle be close to the $A_{r1}$ temperature; and the temperature of the surface layer of the inner hole is lower than the $M_s$, and the surface layer of inner hole exhibits the compressive stress and the sub-surface layer exhibits low tensile stress.

The objective for cooling the inner hole in this stage is to maintain the compressive stress at the surface layer and low tensile stress at sub-the surface layer. The cooling intensity of the inner hole is adjusted according to this objective, through controlling the flow velocity of the quenchant in the inner hole, such as the flow velocity of water in the inner hole. The principle of adjusting the cooling intensity of the inner hole is as follows: when the surface layer and sub-surface layer of the inner hole lie in the martensite transformation region, if rapid cooling continues and the martensitic transformation continues in a deeper layer, it is still possible to form cracks along the surface of the inner hole even if the tensile stress in the sub-surface layer of the inner hole is not increased. At this time, if the flow velocity of the fluid in the inner hole is reduced or the fluid in the inner hole is stopped to fill, the temperature of the surface layer of the inner hole will rise because the external heat dissipation rate is reduced. The martensite formed in the surface layer experiences self-tempering during the temperature rise, which improves the anti-cracking capacity of the martensite in the surface layer, thereby effectively preventing the formation of the quenching cracks.

Preferably, the step 3 includes cooling the outer circle to reduce the temperature of the surface layer of outer circle or the position with required performance of the outer circle to be below the temperature of the $M_s$ or the $B_s$, and martensitic transformation or bainitic transformation is hence occurred, which meets the requirements of microstructures and mechanical properties of the hollow shaft.

Preferably, in step 3, the cooling time is a sum of the time that takes to reduce the temperature of the position required performance of the outer circle to be below the $M_s$ or the $B_s$, plus the holding time at this temperature.

Preferably, in step 3, the cooling intensity and the cooling time of the outer circle and the inner hole are obtained by analyzing the simulation results of temperature field, microstructure field and stress field with finite element method.

Preferably, in step 3, the cooling intensity of the inner hole is adjusted to gradually reduce by controlling the flow velocity of the quenchant in the inner hole.

Preferably, the quenchant used in the cooling process of step 2 and step 3 is any one of water, polymer aqueous solution or salt solution, and is more preferably quenchant at different temperatures, such as water at different temperatures.

Preferably, the hollow shaft may be a shaft with different shapes, such as: long shaft, stepped wind-electric spindle and so on, and also may be a shaft with a special-shaped inner hole.

Preferably, the alloy steel workpiece may be low-carbon, medium-carbon and high-carbon alloy steel, or may be low-hardenability alloy steel, medium-hardenability alloy steel and high-hardenability alloy steel, also may be carbon steel, or may be a rolled, forged and machined workpiece, or may be a workpiece with simple shape or complex shape.

Compared with the traditional technology, the invention has the following beneficial effects.

In the invention, in the case of air cooling on the outer circle of the hollow shaft, the inner hole is cooled for a long time, realizing that the inner hole cools for a long time in advance the outer circle, forming compressive stress on the surface layer of the inner hole, and forming smaller tensile stress on the sub-surface layer, reducing the probability of quenching crack on the surface of the inner hole. However, the traditional technology is to quench the hollow shaft by immersing it in water. In particular, the hollow shaft with large size and small hole-diameter, since its large thick wall causes a large temperature gradient, resulting in the formation of a large tensile stress in the surface layer of the inner hole, moreover, the greater the wall thickness is, the greater the probability of crack generation on the surface of the inner hole is, usually inevitable.

In the invention, when the inner hole and the outer circle are cooled at the same time, the cooling intensity of the inner hole can also be adjusted to gradually reduce so that sub-surface layer of the inner hole keeps low tensile stress while martensite formed in the surface layer experiences self-tempering, which further decreases the probability of the quenching crack formation along the surface of the inner hole.

In the invention, the horizontal water quenching is performed to the hollow shaft. In the horizontal water quenching, the axial line of the hollow shaft is either parallel to the water surface, or angled with the water surface. The cracking problem during horizontal water quenching for hollow shafts is solved.

DESCRIPTION OF THE APPENDED DRAWINGS

Other features, purposes and advantages of the invention will become more apparent by reading the detailed description of embodiments in reference to the following appended drawings.

Figure 1:
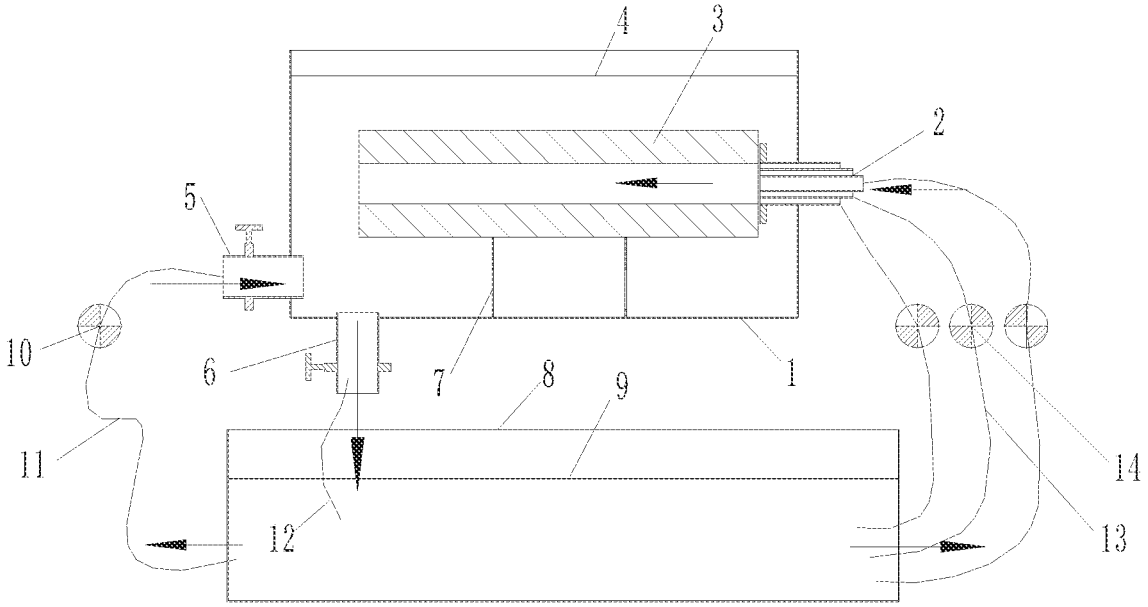
FIG. 1 is a structural schematic diagram of a preferred embodiment in the invention.

Shown in the figure marked, respectively is: a quenching tank 1; a outlet of a water injection pipeline for inner hole 2; a quenching workpiece 3; the liquid level in quenching tank 4; an water injection valve for immersion 5; a drainage valve 6; a horizontal rest for workpiece 7; water storage tank 8; liquid level in the water storage tank 9; a water injection pump for outer circle 10; a water injection pipeline for outer circle 11; a water drainage pipeline 12; a water injection pipeline for inner hole 13; a water injection pump for inner hole 14; a tilting rest for workpiece 15; a first pipeline 21; a second pipeline 22; a third pipeline 23; and a sealing plate 24.

Running of equipment during water quenching. Specifically, the horizontal quenching equipment includes: a water storage tank 8, a quenching tank 1, a water injection system for inner hole, and a water injection system for outer circle. The water storage tank 8 is used to store liquid, as shown in FIG. 1. Liquid is filled into the water storage tank 8 until reaching liquid level 9 of the water storage tank. The water storage tank 8 is provided with a first exit and a second exit. The first exit is used to connect the water injection system for the inner hole, and the second exit is used to connect the water injection system for the outer circle. Quenching tank 1 is equipped with inlet end and drainage system. Quenching tank 1 is used to accommodate quenching workpiece 3. Quenching workpiece 3 is set in quenching tank 1 to conduct horizontal quenching for quenching workpiece 3. The quenching workpiece 3 is a hollow shaft. The inlet end of the quenching tank 1 is used to feed liquid into the quenching tank 1. The inlet end of quenching tank 1 includes a first inlet end and a second inlet end. The first inlet end is connected to the water injection system for the inner hole. The second inlet end is connected to the water injection system for the outer circle. The water drainage system is arranged on one side or the bottom of the quenching tank 1. The water drainage system is used to drain liquid in the quenching tank 1. The water drainage system is composed of a water drainage pipeline 12 and a water drainage valve 6. The water drainage valve 6 is arranged on a bottom plate of the quenching tank 1. The inlet end of the water drainage valve 6 is connected with the quenching tank 1. The outlet end of the water drainage valve 6 is connected with the water storage tank 8. The water drainage valve 6 is used to control the switch of liquid flow in the water drainage pipeline 12. In FIG. 1, the water drainage valve 6 is arranged on a bottom plate of the quenching tank 1, while the water storage tank 8 is arranged below the quenching tank 1 so that the liquid is conveniently drained from the quenching tank 1 into the water storage tank 8, and the path of the water drainage pipeline is shortened. The water injection system for the inner hole is connected with the water storage tank 8 and the quenching tank 1, respectively. The liquid in the water storage tank 8 is injected into the inner hole of the quenching workpiece 3 in the quenching tank 1 by the water injection system. The liquid is drained through the inner hole by the water drainage system, which cools the inner hole.

As shown in FIG. 1, the water injection system for the inner hole is composed of a water injection pipeline 13, a water injection pump 14 and an outlet 2 of the water injection pipeline, which are connected with one another. One end of the water injection pipeline 13 is connected with the first outlet end of the water storage tank 8, and another end of the water injection pipeline 13 is connected with one end of the inner hole through the first inlet end of the quenching tank 1. The liquid in the water storage tank 8 is injected into the inner hole of the quenching workpiece 3 in the quenching tank 1 through the water injection pipeline 13. The water injection pump 14 is arranged on the water injection pipeline 13, and is used to inject the liquid in the water storage tank 8 into the inner hole through the water injection pipeline 13. In specific implementation, the liquid level 4 in the quenching tank 1 is lower than the quenching workpiece 3 when the inner hole of the quenching workpiece 3 is cooled alone.

Figure 2:
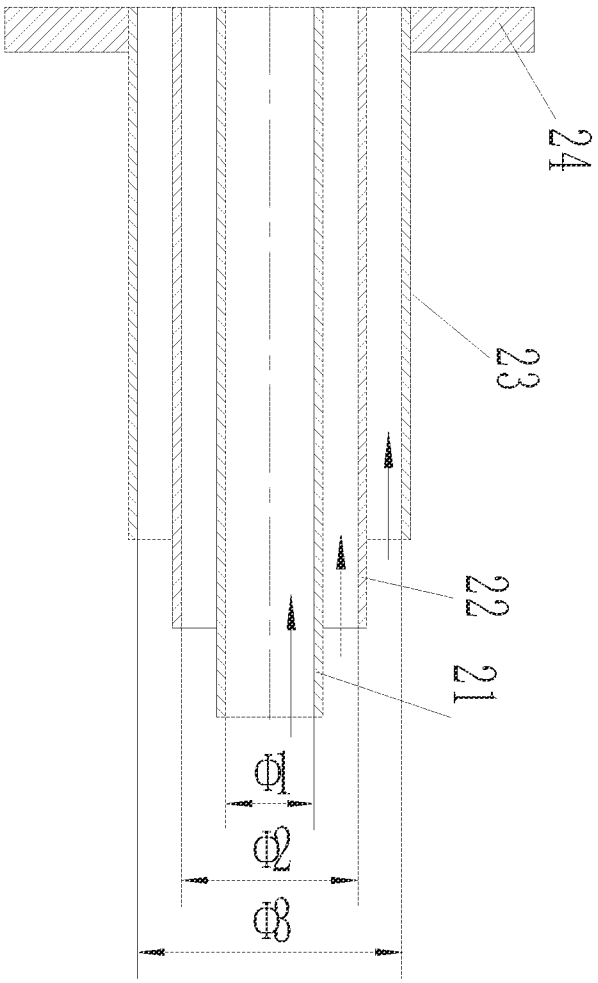
FIG. 2 is a schematic diagram of the outlet structure of a water injection pipeline for inner hole in a preferred embodiment of the invention.

The outlet 2 of water injection pipeline is located at the first inlet end of the quenching tank 1. One end of the outlet of water injection pipeline 2 is connected with the outlet end of the water injection pipeline 13, and the other end of the water outlet of water injection pipeline 2 is arranged at one end of the inner hole of the quenching workpiece 3, and is used to feed the liquid into the inner hole through the outlet of water injection pipeline 2. In a preferred embodiment, as shown in FIG. 2, the outlet of water injection pipeline 2 includes several injection water outlets with different diameters which are concentrically packaged, so as to be applicable to quenching workpieces 3 with inner holes of different diameters. In specific implementation, one, two, three or more injection water outlets may be used, so as to selectively open the injection water outlet of corresponding diameter when the diameter of the inner hole of the quenching workpiece 3 changes.

During specific implementation process, as shown in FIG. 1 and FIG. 2, the outlet of water injection pipeline 2 consists of three outlets of different diameters concentrically packaged and pipelines of different diameters may be respectively connected with a first pipeline 21, a second pipeline 22 and a third pipeline 23. The w outlets of the three pipelines are connected with a sealing plate 24. The diameter φ1 of the first pipeline is 180 mm, the diameter φ1 of the second pipeline 22 is 250 mm, and the diameter φ3 of the third pipeline 23 is 320 mm. The injection water outlets of different diameters are selectively opened according to the corresponding diameter of the inner hole of the quenching workpiece 3. The sealing plate 24 is arranged on the end face of the outlet of water injection pipeline 2, and is used to prevent leakage of the liquid. During specific implementation process, one end of the quenching workpiece 3 is clung to the sealing plate 24.

The water injection system for outer circle is connected with the water storage tank 8 and the quenching tank 1. The water injection system injects the liquid in the water storage tank 8 into the quenching tank 1, and the quenching workpiece 3 is in whole immersed in the liquid. The liquid is drained by the liquid drainage system to cool the outer circle of the quenching workpiece 3. The water injection system is composed of a water injection pump 10 for the outer circle, a water injection pipeline 11 for the outer circle and a water injection valve for immersion 5 which are connected with each other. The water injection pump 10 is arranged on the water injection pipeline 11. The liquid in the water storage tank 8 is injected into the quenching tank 1 through the water injection pump 10 to immerse the whole quenching workpiece 3 into the liquid. In the running mentioned above, one end of the water injection pipeline 11 is connected with the second outlet end of the water storage tank 8, and the other end of the water injection pipeline 11 is connected with the liquid inlet end of the water injection valve for immersion. The liquid in the water storage tank 8 is injected into the quenching tank 1 through the water injection pipeline 11. The liquid level in the tank rises to reach the liquid level 4 of the quenching tank to immerse the whole quenching workpiece 3 into the liquid. The water injection valve for immersion 5 is set at the second inlet end of quenching tank 1 to control the switch of liquid flow in the water injection line for outer circle 11.

The outlet end of the water drainage valve 6 is connected with the water storage tank 8, so that the liquid in the quenching tank 1 is injected into the water storage tank 8 to enable the liquid to be circulated between the water storage tank 8 and the quenching tank 1 through the water injection pipeline 13 for inner hole and/or the water injection pipeline 11 for out circle.

A horizontal rest for workpiece 7 is arranged on the bottom plate of the quenching tank 1. The quenching workpiece 3 is arranged on the rest for workpiece 7, and the rest for workpiece 7 is used to support the quenching workpiece 3. A tilting device is arranged on the rest for workpiece 7, and the tilting device is used to change an included angle between the axis line of the quenching workpiece and a horizontal level, which make the liquid flow more smoothly in the inner hole and increases the cooling rate. The tilting angle can be determined according to the situation. Meanwhile, the angle of outlet 2 of the water injection line for inner hole can also be changed with the same angle.

In some preferred embodiments, the quenching tank 1 and the water storage tank 8 are coverless tank bodies, and are used to accommodate the liquid, and it may be tank bodies of any shape. The quenching workpiece 3 may be any one of long shaft, stepped wind-electric spindle and so on, or shaft with a special-shaped inner hole.

DETAILED DESCRIPTION OF PREFERRED EMBODIMENTS

The invention is described in detail in combination with specific embodiments below. The following embodiments will facilitate technical personnel in the field to further understand the invention. It should be noted that if a number of modifications made by technical personnel in the field do not deviate from the idea of the invention, these modifications will fall within the protection scope of the invention.

Embodiment 1

The present embodiment specifically relates to a method for preventing cracking along the surface at the inner hole of a hollow shaft during horizontal water quenching. The horizontal water quenching is performed on a 42CrMo long hollow shaft. The specifications of the product are given, its outer-circle diameter is 500 mm, its inner-hole diameter is 300 mm, and its length is 3000 mm.

According to the process, the quenching and tempering (550° C. for 10 h) are required. The following mechanical properties are required at the position that is 27 mm away from the surface of the outer circle after the quenching and tempering: Rm≥700 MPa, Rp≥460 MPa, A≥15%, and $A_{kv2}$ (−20° C.)≥27 J.

In the quenching cooling process, the austenitizing temperature is 850° C., and the water quenching i.e., horizontal immersion quenching, is used with the water temperature of 20° C.

In step 1, the workpiece is transferred. The long hollow shaft is transferred from heating furnace into quenching equipment, and the transferring time is controlled to be shorter than 180 s.

In step 2, the inner hole of the long shaft is cooled alone. The inner hole is filled with fast-flowing water, so that the inner hole is cooled alone in advance, while the outer circle is still in the state of air cooling. During the specific implementation, the filling water flow in the inner hole is 800 $m^3$/h, and the duration of filling is 420 s.

In step 3, the outer circle and the inner hole are cooled at the same time. During the specific implementation, the cooling duration is 900 s, the filling water flow in the inner hole is 800 $m^3$/h, and the outer circle is cooled with a flow velocity of 0.2 m/s.

In step 4, stop the water injection cooling of both inner hole and outer circle, and then drain the water in the quenching tank.

It is found after detection that, no quenching crack is formed on the inner hole or the outer circle, and the mechanical properties required are met.

Embodiment 2

In the present embodiment, the horizontal water quenching is performed on a long shaft made of 34CrNiMo6, and the specifications of the product to be treated are given, its outer-circle diameter is 800 mm, its inner-hole diameter is 260 mm, and its length is 2500 mm.

Quenching and tempering (550° C. for 15 h) are required. The following mechanical properties are required at a position that is 30 mm away from the surface of the outer circle after the quenching and tempering: Rm≥860 MPa, Rp≥700 MPa, A≥16%, and $A_{kv2}$ (−40° C.)≥27 J.

In the quenching process, the austenitizing temperature is 850° C., and water quenching, i.e., horizontal immersion quenching, is used with a water temperature of 25° C.

In step 1, the workpiece is transferred. The long shaft made of 34CrNiMo6 is transferred from heating furnace into quenching equipment, and the transferring time is controlled to be shorter than 240 s.

In step 2, the inner hole is cooled alone. The inner hole of the long shaft made of 34CrNiMo6 is filled with fast-flowing water, so that the inner hole is cooled alone in advance, while the outer circle is in the state of air cooling. The filling water flow in the inner hole is 600 $m^3$/h, and the duration of filling is 120 s.

In step 3, the inner hole is continuously cooled for a duration of 540 s, and the filling water flow in the inner hole is 400 $m^3$/h; the water-air alternative timed quenching (ATQ) process is performed to the outer circle, i.e., water-cooled 240 s+ air-cooled 120 s+ water-cooled 180 s+ air-cooled 180 s+ water-cooled 120 s. When the outer circle is water-cooled, the water velocity is 0.2 m/s.

In step 4, stop the water injection cooling of both inner hole and outer circle, and then drain the water in the quenching tank.

It is found after detection that, no quenching crack is formed on the inner hole or the outer circle, and the mechanical properties required are met.

Embodiment 3

In the present embodiment, the horizontal water quenching is performed on a long shaft made of 40Cr, and the specifications of the product to be treated are given, its outer-circle diameter is 400 mm, its inner-hole diameter is 150 mm, and its length is 1500 mm.

Quenching and tempering (550° C. for 10 h) are required. The following mechanical properties are required at a position that is 18 mm away from the surface of the outer circle after the quenching and tempering: Rm≥650 MPa, Rp≥400 MPa, A≥16%, and $A_{kv2}$ (room temperature)≥27 J.

In the quenching cooling process, the austenitizing temperature is 840° C., and water quenching, i.e., horizontal immersion quenching is used with a water temperature of 20° C.

In step 1, the workpiece is transferred from heating furnace into quenching equipment, and the transferring time is controlled to be shorter than 180 s.

In step 2, the inner hole of the long shaft made of 40Cr is cooled alone. The inner hole is filled with fast-flowing water, so that the inner hole is cooled alone in advance, while the outer circle is in the state of air cooling. The filling water flow in the inner hole is 400 $m^3$/h, and the duration of filling is 180 s.

In step 3, the outer circle and the inner hole of the long shaft made of 40Cr are cooled at the same time. During the specific implementation, the filling water time is 480 s, in which in the first 240 s the filling water flow into the inner hole is 400 $m^3$/h, in after 240 s, the injection of water is stopped. For the cooling of the outer circle, the flow velocity is 0.2 m/s for a duration of 480 s.

In step 4, stop the water injection cooling of both inner hole and outer circle, and then drain the water in the quenching tank.

It is found after detection that, no quenching crack is formed on the inner surface or the outer circle, and the mechanical properties required are met.

Embodiment 4

In the present embodiment, the horizontal water quenching is performed on a long shaft made of 42CrMo, and the specifications of the product to be treated are given, its outer-circle diameter is 800 mm, its inner-hole diameter is 300 mm, and its length is 1500 mm.

Quenched and tempering (600° C. for 20 h) is required. The following mechanical properties are required at the position that is 30 mm away from the surface of the outer circle after the quenching and tempering: Rm≥700 MPa, Rp≥460 MPa, A≥15%, and $A_{kv2}$ (−20° C.)≥30 J.

Austenitization temperature is 850° C., and water temperature is 20° C.

In the step 1, the 42CrMo long shaft is transferred from the heating furnace to the quenching equipment, and the transferring time is controlled to be shorter than 180 s.

In the step 2, the 42CrMo long axis is tilted by 15° from the horizontal level.

In the step 3, the inner hole is cooled alone, and the water injection flow through the inner hole is 800 $m^3$/h, lasting 420 s.

In the step 4, the outer circle and the inner hole were cooled simultaneously: the cooling time was 900 s, the water filling flow in the inner hole is 800 $m^3$/h, and the outer circle was cooled at a flow rate of 0.2 m/s.

The step 5, stop the water injection cooling of both inner hole and outer circle, and then drain the water in the quenching tank.

Figure 3:
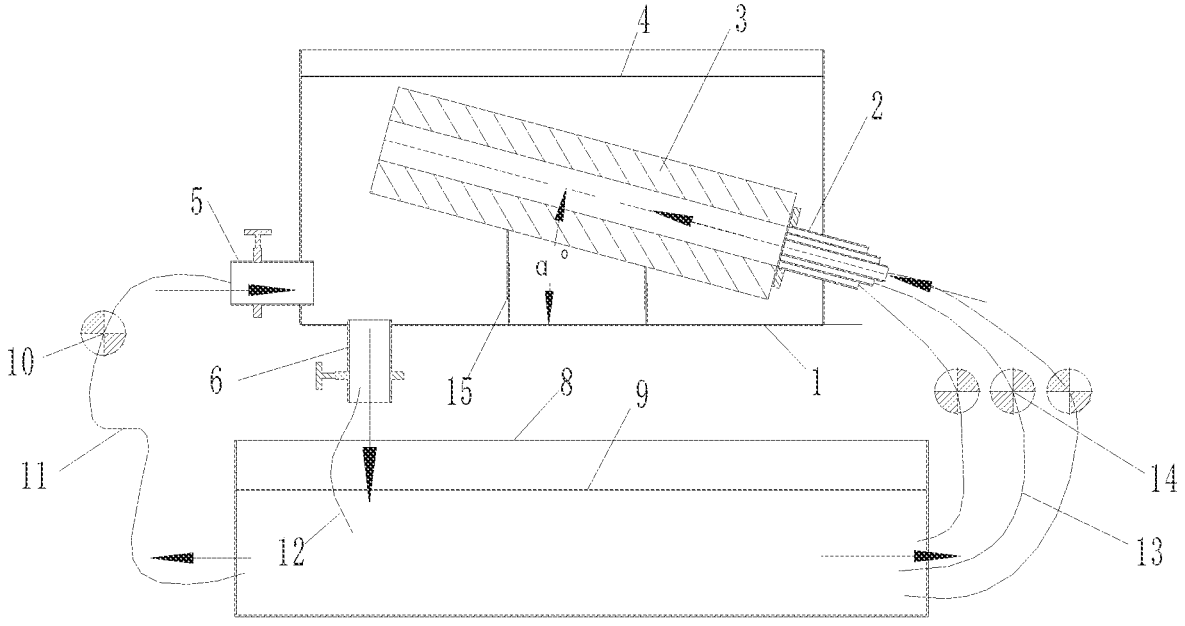
FIG. 3 is a structural schematic diagram of embodiment 4 in the invention.

Note:

As shown in FIG. 3, this embodiment adopts tilting rest for workpiece 15 to quench, an tilting rest for workpiece 15 is provided with two telescopic supports at the bottom. By adjusting the height of one of the telescopic supports, the included angle (a) between the inner hole of long hollow shaft and the horizontal level can be changed. It is used to change the included angle between the axis line of inner hole and the horizontal plane. When the axis line of workpiece 3 is tilted by a certain angle with the horizontal level, the axis line of outlet 2 of the inner hole in water injection pipeline is also tilted in the same angle. In the specific implementation of this embodiment, $\alpha$=15°.

The difference between the present embodiment and embodiment 1 is that it has a larger wall thickness (800 mm−300 mm=500 mm). Therefore, the adoption of inclined water quenching process effectively enhances the cooling rate of the inner hole. According to the test, there is no quenching crack in the inner hole or the outer circle, and the higher impact toughness required ($A_{kv2}$ (−20° C.)≥30 J) than $A_{kv2}$ (−20° C.)≥27 J in embodiment 1 is met.

Embodiment 5

In the present embodiment, the horizontal water quenching is performed on a hollow wind-electric spindle with stepped shape made of 42CrMo, and the specifications of the product to be treated are given: outer circle size and length of large circle end are φ1200*300 (mm), middle part of outer circle size and length are φ880*2900 (mm) and outer circle size and length of small circle end are φ660*1000 (mm).

Quenching and tempering (630° C. for 20 h) are required. Mechanical properties of the position 30 mm away from the surface of the inner hole after tempering from 1500 mm away from the end of the large circle (outer circle diameter 880) are required: Rm≥700 MPa, Rp≥460 MPa, A≥15%, and $A_{kv2}$ (−20)≥30 J.

Previous practice shows that when the traditional technology is used, a hollow wind-electric spindle with the large size and small hole-diameter will be in whole immersed in water to quench, even if the ATQ process is applied, the cracks on the surface of inner hole at the large wall thickness still are inevitably generated. The finite element simulation shows that the tensile stress in the sub-surface layer of the inner hole can be reduced by cooling the inner hole in advance, changing both the cooling strength and precooling time of the inner hole.

Finally, the water quenching process with minimum tensile stress in sub-surface layer is determined: austenitizing temperature was 850° C. Quenching process: the transfer time of wind-electric spindle is less than 180 s, and the inner hole of wind-electric spindle is cooled by water injection alone for 420 s (the water injection flow is 800 $m^3$/h and the water flow rate is 3 m/s), after that the whole wind-electric spindle is put into the quenching tank for horizontal water quenching for 640 s (the water flow rate in the quenching tank is 0.2 m/s, and at this time the water injection in the inner hole is stopped alone). Finally the wind-electric spindle comes is tempered at 630° C. for 20 h in the tempering furnace.

The finite element simulation results show that the differential quenching (the differential time between cooling of the inner hole and the cooling of the outer circle) and grading quenching (the intensity of cooling in the inner hole gradually reduce in grade) make the surface layer of the inner hole appear compressive stress and the maximum tensile stress of the sub-surface layer is only 220 MPa. The results show that the mechanical properties of wind-electric spindle with the large size and small hole-diameter treated by the above process are met, and there is no crack on the surface of the inner hole at the largest wall thickness.

The invention is described by five embodiments above. It is important to understand that the invention is not limited to the specific mode of implementation mentioned above. If the technical personnel in the field make various modifications within the scope of this claim, it still falls within the protection scope of the invention.

We claim:

1. A method for preventing cracking along the surface of the inner hole of a hollow shaft during horizontal water quenching, comprising:

Step 1: transferring the shaft from a heating furnace to quenching equipment;

Step 2: cooling the inner hole of the shaft alone, and cooling intensity for a prolonged time is defined by a first phase while keeping an outer circle of the shaft in a state of air cooling in the first phase, wherein the cooling of the inner hole of the shaft is performed by filling the inner hole with flowing quenchant, in such a way that a temperature of a surface layer or a sub-surface layer of the inner hole lowers with time elapse in the first phase to be lower than a start temperature of martensitic transformation ($M_s$) after the prolonged time of cooling to cause partial martensitic transformation, and to induce a compressive stress in the surface layer of the inner hole and a low tensile stress in the sub-surface layer; and wherein the outer circle of the shaft is kept in the state of air cooling such that a temperature of the outer circle is lowered toward a start temperature ($A_{r1}$) for transforming from austenite to pearlite; and Step 3: simultaneously cooling the outer circle and the inner hole of the shaft treated in step 2 in a second phase, wherein during the cooling in the second phase, the inner hole is subjected to quench by flowing quenchant at a second cooling intensity, which is lower than the first cooling intensity, by supplying the flowing quenchant at a reduced flowing rate, so that the sub-surface layer of the inner hole still keeps in low tensile stress and the surface layer and the sub-surface layer of the inner hole experience a rise in the temperature thereof to cause the martensite formed in the surface layer to undergo self-tempering, the shaft is subjected to cooling with the flowing quenchant such that in a first phase corresponding to step 2, the inner hole is solely cooled with quenchant, while the outer circle is set in the state of air cooling, and in a subsequent, the second phase corresponding to step 3, both the inner hole and the outer circle are simultaneously cooled with the quenchant, wherein the inner hole is cooled in the second phase, moreover, the cooling intensity is lower than a cooling intensity applied in the first phase such that the surface layer and the sub-surface layer of the inner hole experience a rise of temperature so that causes self-tempering of martensite in the surface layer to help prevent cracking formed in the surface layer, and wherein the lowering of the cooling intensity of the inner hole is achieved by reducing a flowing rate of the flowing quenchant so as to keep a state of stress of each of the surface layer and the sub-surface layer in the second phase almost identical to that in the first phase.

2. The method according to claim 1, further comprising:

Step 4: keeping cooling the inner hole while the cooling of the outer circle is stopped; or keeping cooling the inner hole while the outer circle is cooled via water-air alternative timed quenching (ATQ) process.

3. The method according to claim 1, wherein in step 3, the outer circle is cooled in the second phase so that a temperature of a surface layer of the outer circle or a designated part near of the outer circle is lowered to a predetermined temperature, that is, below $M_s$ or a start temperature of bainitic transformation ($B_s$), so as to cause martensitic or bainitic transformation.

4. The method according to claim 3, wherein in step 3, the predetermined time period that the outer circle and the inner hole are simultaneously cooled is sum of the first phase in which the temperature of the surface layer of the inner hole is lowered to the predetermined temperature that is below $M_s$ and the second phase in which the predetermined temperature of outer circle is below $M_s$ or $B_s$.

5. The method according to claim 1, wherein in step 3, the second cooling intensity of the inner hole is gradually lowered by reducing a flow velocity of flowing quenchant in the inner hole.

6. The method for according to claim 1, wherein the quenchant used in step 2 and step 3 comprises one of water, polymer aqueous solution, and a salt solution.

* * * * *